US010760554B2

(12) United States Patent
Hoppe et al.

(10) Patent No.: US 10,760,554 B2
(45) Date of Patent: Sep. 1, 2020

(54) HYDROSTATIC AXIAL PISTON MACHINE

(71) Applicant: Robert Bosch GmbH, Stuttgart (DE)

(72) Inventors: Stefan Hoppe, Sulz A.N. (DE); Timo Nafz, Horb (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 16/375,025

(22) Filed: Apr. 4, 2019

(65) Prior Publication Data

US 2019/0309738 A1 Oct. 10, 2019

(30) Foreign Application Priority Data

Apr. 4, 2018 (DE) ..... 10 2018 205 010

(51) Int. Cl.

| | |
|---|---|
| ***F04B 1/2035*** | (2020.01) |
| ***F04B 53/16*** | (2006.01) |
| ***F04B 1/124*** | (2020.01) |
| ***F04B 1/2078*** | (2020.01) |

(52) U.S. Cl.

CPC ..... *F04B 1/2035* (2013.01); *F04B 1/124* (2013.01); *F04B 1/2078* (2013.01); *F04B 53/166* (2013.01)

(58) Field of Classification Search

CPC .... F04B 1/2035; F04B 39/126; F04B 53/166; F04B 53/168

USPC ..... 92/169.1, 171.1

See application file for complete search history.

(56) References Cited

U.S. PATENT DOCUMENTS

| | | | | |
|---|---|---|---|---|
| 1,347,480 A | | 7/1920 | Jeffries | |
| 4,492,529 A | * | 1/1985 | Grisbrook ..... | F04B 39/126 417/242 |
| 6,675,750 B1 | | 1/2004 | Wagner | |

FOREIGN PATENT DOCUMENTS

| | | |
|---|---|---|
| AT | 188561 B | 1/1957 |
| DE | 2 109 189 | 9/1972 |
| DE | 696 18 308 T2 | 8/2002 |
| DE | 101 57 248 A1 | 4/2003 |
| DE | 10 2012 214 833 A1 | 3/2013 |
| DE | 10 2013 208 454 A1 | 11/2014 |
| DE | 10 2014 202 108 A1 | 8/2015 |
| FR | 2 527 270 | 11/1983 |
| JP | 2579990 B2 | 2/1997 |

* cited by examiner

*Primary Examiner* — Michael Leslie

(74) *Attorney, Agent, or Firm* — Maginot, Moore & Beck LLP

(57) ABSTRACT

A hydrostatic axial piston machine includes a cylinder drum having a substantially hollow cylindrical base body, and liners. The body includes cylinder bores located around a central axis. The liners have an outer diameter press-fitted into the bores such that an outer end face of each liner is positioned in a region of an opening of a respective bore, and such that an inner end face of each liner is positioned deep within the respective bore. An outer half of each liner, starting from the outer end face, includes an axially delimited circumferential recess in an outer casing surface of the liner. The machine is configured to operate with great forces acting between the liners and displacement pistons. The recess in each liner is shaped such that, in an axial section through the liner enclosing an axis of the liner, a depth of the recess increases more than once and decreases more than once.

20 Claims, 3 Drawing Sheets

HYDROSTATIC AXIAL PISTON MACHINE

This application claims priority under 35 U.S.C. § 119 to patent application no. DE 10 2018 205 010.4, filed on Apr. 4, 2018 in Germany, the disclosure of which is incorporated herein by reference in its entirety.

The disclosure concerns a hydrostatic axial piston machine with a cylinder drum which comprises a substantially hollow cylindrical base body in which cylinder bores are arranged around a central axis, and liners which are pressed into the cylinder bores with a fitting outer diameter, an outer end face of which is situated in the region of an opening of the cylinder bores and an inner end face of which is situated deep inside the cylinder bores. In its outer half starting from the outer end face, each liner has an axially delimited, circumferential recess region in its outer casing surface. In particular, hydrostatic axial piston machines in swashplate design are equipped with liners.

BACKGROUND

Hydrostatic axial piston machines are operated under widely varying operating conditions, wherein the liners must tolerate the loads occurring in the operating states so that the axial piston machine does not fail prematurely. For example, DE 10 2013 208 454 A1 or DE 1 703 403 each describe a hydrostatic axial piston machine in which the liners pressed into the cylinder bores are intact hollow cylinders without any recesses. Such intact liners withstand the loads occurring at high operating pressures and have no tendency to crack. At high operating pressures, the leakage through the gap between the liners and the displacement pistons moving to and fro in the liners is so high that the guide faces between the displacement pistons and the liners are well lubricated and the generated heat is dissipated well. If however the axial piston machine is running with a high rotation speed and at the same time the operating pressures are only low, there is a tendency towards adhesion between the liners and the displacement pistons and hence so-called piston seizure, since the leakage through the gap between the liner and the displacement piston is reduced, so that generated heat is not dissipated so well and the components heat to the point that their expansion is no longer negligible.

DE 10 157 248 A1 discloses a hydrostatic piston machine in which the liners pressed into the cylinder bores have an axially delimited, circumferential recess region in their outer half starting from their outer end face. In the known liners, called compensated liners, the recess region is formed as a circumferential groove which has a contour formed as a circle arc in an axial section passing through the axis of the liner. The groove is situated in a region in which the greatest forces occur between the displacement piston and the liner, and in which the liner is accordingly exposed to the greatest heat load. The circumferential groove creates a clearance between the liner and the wall of the cylinder bore, into which the liner can expand. Accordingly, liners with a recess can withstand operating states with high rotation speeds and low pressures. If however a hydrostatic axial piston machine with compensated liners is operated mainly at high operating pressures, there is a possibility that the liners will break prematurely.

Therefore, it is already known that a hydrostatic axial piston machine for a specific application in which primarily the one operating state occurs is equipped with intact liners, and a hydrostatic axial piston machine for another application case in which primarily the other operating state occurs is equipped with compensated liners. Such a procedure means additional cost in planning of a plant and additional cost in procurement, stockholding and provision of the different liners, and in assembly of the different variants of an axial piston machine. Also, there are many applications in which the one operation type does not occur significantly more often than the other operation type, but fulfilment of the requirements for both operation types would be of great advantage.

SUMMARY

The disclosure is based on the object of refining a hydrostatic axial piston machine, with a cylinder drum which comprises a substantially hollow cylindrical base body in which cylinder bores are arranged around a central axis, and liners which are pressed into the cylinder bores with a fitting outer diameter, an outer end face of which is situated in the region of an opening of the cylinder bores and an inner end face of which is situated deep inside the cylinder bores, wherein in its outer half starting from the outer end face, each liner has an axially delimited, circumferential recess region in its outer casing surface so that its possible applications may be extended to application cases with high forces acting between the liners and the displacement pistons.

For a hydrostatic axial piston machine with the features given above, this object is achieved in that the recess region of a liner is configured such that in an axial section through the liner enclosing the axis of the liner, the depth of the recess region increases more than once and decreases more than once.

Whereas in the known hydrostatic axial piston machine, in an axial section through the liner enclosing the axis of the liner, the depth of the groove initially increases to a maximal depth and from there again decreases towards zero, in a hydrostatic axial piston machine according to the disclosure, the recess region of the liners is configured such that in an axial section, the depth increases several times and decreases several times. In this way, inside the recess region, protrusions occur which do not reach as far as the fitting outer diameter of the liner, or several recesses are formed which are separated from each other by faces lying on the fitting outer diameter of the liner. In some cases, the liner is thus permanently supported inside the recess region, or supported after a specific outward expansion, by the cylinder wall so that the risk of cracking is reduced. Secondly, because of the regions of greater depth between a liner and a cylinder wall, there remains sufficient clearance into which the liner can expand so there is no danger of piston seizure.

Advantageous embodiments of an axial piston machine according to the disclosure can be found in the claims, description, and drawings.

It is particularly advantageous if a recess is present in the recess region and has a protrusion which ends below the fitting outer diameter of the liner. The protrusion creates an increase in wall thickness of the lining inside the recess region, whereby the strength of the lining in the recess region is increased. The liner is first supported by this protrusion when a specific deformation of the liner has already occurred. The protrusion may have a pointed or linear highest point.

The base of the recess with the protrusion is curved at least in regions and the curvature there is greater than zero and less than infinity. A curvature greater than zero means that the base has no corner, and a curvature less than infinity means that the base has no straight portions. This reduces the risk of cracking. Advantageously, the entire base of the recess including the protrusion is formed without edges and without straight portions.

In a particularly advantageous refinement, the protrusion takes up most of the width, preferably between 70% and 85% of the width of the recess.

It is favorable to form the base contour of a recess with circle arcs. Thus, from an edge lying on the fitting outer diameter of a liner, the base of the recess falls away following a first circle arc which is concave towards the fitting outer diameter, i.e. curving inward, and has a small radius, to a lowest point and thereafter is continued. A second circle arc, which is convex towards the fitting outer diameter, i.e. curving outward, and has a substantially larger radius, adjoins the first circle arc with a constant tangent. Preferably, the radius of the first circle arc is approximately 2 mm and the radius of the second circle arc is between 20 mm and 60 mm. The second circle arc forms the protrusion.

Advantageously, the protrusion is situated centrally inside the recess.

The form of the recess base described above is particularly clear if the data are regarded as data for the course of the base in an axial section through a liner.

In a particularly preferred embodiment, the recess runs in the manner of a ring around the liner and has the same contour in each axial section enclosing the axis of the liner.

Several individual recesses may be present in the recess region of the liner, which are separated from each other by faces or edges lying on the fitting outer diameter of the liner. Preferably, several individual recesses are arranged successively in the axial direction of the liner, and run in the manner of a ring around the liner and have the same contour in each axial section enclosing the axis of the liner.

Here preferably, a first individual recess as a main recess has a first dimension in the axial direction of the liner, and a second individual recess directly following the main recess in the axial direction of the liner, as a secondary recess, has a second dimension in the axial direction which is smaller than the first dimension.

Preferably, the main recess has the protrusion which ends below the fitting outer diameter of the liner. The secondary recess has no protrusion, but rather in an axial section enclosing the axis of the liner has a contour following which the depth of the secondary recess increases only once and decreases only once, and in particular is a circle arc.

A secondary recess may be situated on either side of the main recess, wherein the secondary recess on the one side of the main recess is formed in the same way as the secondary recess on the other side of the main recess. Thus a symmetrical form of the recess region is possible in a radial plane standing perpendicularly on the axis of the liner and running through the highest point of the protrusion.

Two individual recesses arranged successively in the axial direction of the liner may have different maximal depths, i.e. the one individual recess is deeper than the other individual recess.

Advantageously, the recess region comprises a central main recess running in the manner of a ring around the liner, and on each side of the main recess a secondary recess running in the manner of a ring around the liner, wherein the secondary recesses are separated by the ring faces of the main recess lying on the fitting outer diameter of the liner. Here, the main recess is substantially wider than the two secondary recesses, preferably five to seven times wider than the two secondary recesses, and in its middle comprises the protrusion which ends below the fitting outer diameter of the liner, while the depth of the secondary recesses increases and decreases only once. The secondary recesses therefore have no protrusion.

In a further advantageous embodiment, the main recess between the protrusion and a ring face lying on the fitting outer diameter of the liner has a maximal depth which is greater than the maximal depth of the secondary recesses. The minimal depth of the main recess, namely the depth at the highest point of the protrusion, is smaller than the maximal depth of the secondary recesses.

Even if the main recess between the protrusion and a ring face lying on the fitting outer diameter of the liner has a maximal depth which is greater than the maximal depth of the secondary recesses, the main recess and the secondary recesses may fall away from a ring face lying on the fitting outer diameter of the liner following a contour which can be described by the same mathematical formula, in particular a circle arc, first steeply and then flatly to the respective maximal depth.

BRIEF DESCRIPTION OF THE DRAWINGS

Two exemplary embodiments of a hydrostatic axial piston machine according to the disclosure are shown in the drawings, wherein only an extract of a liner of the second exemplary embodiment is shown. The disclosure is now explained in more detail with reference to the drawings.

The drawings show.

DETAILED DESCRIPTION

Figure 1:
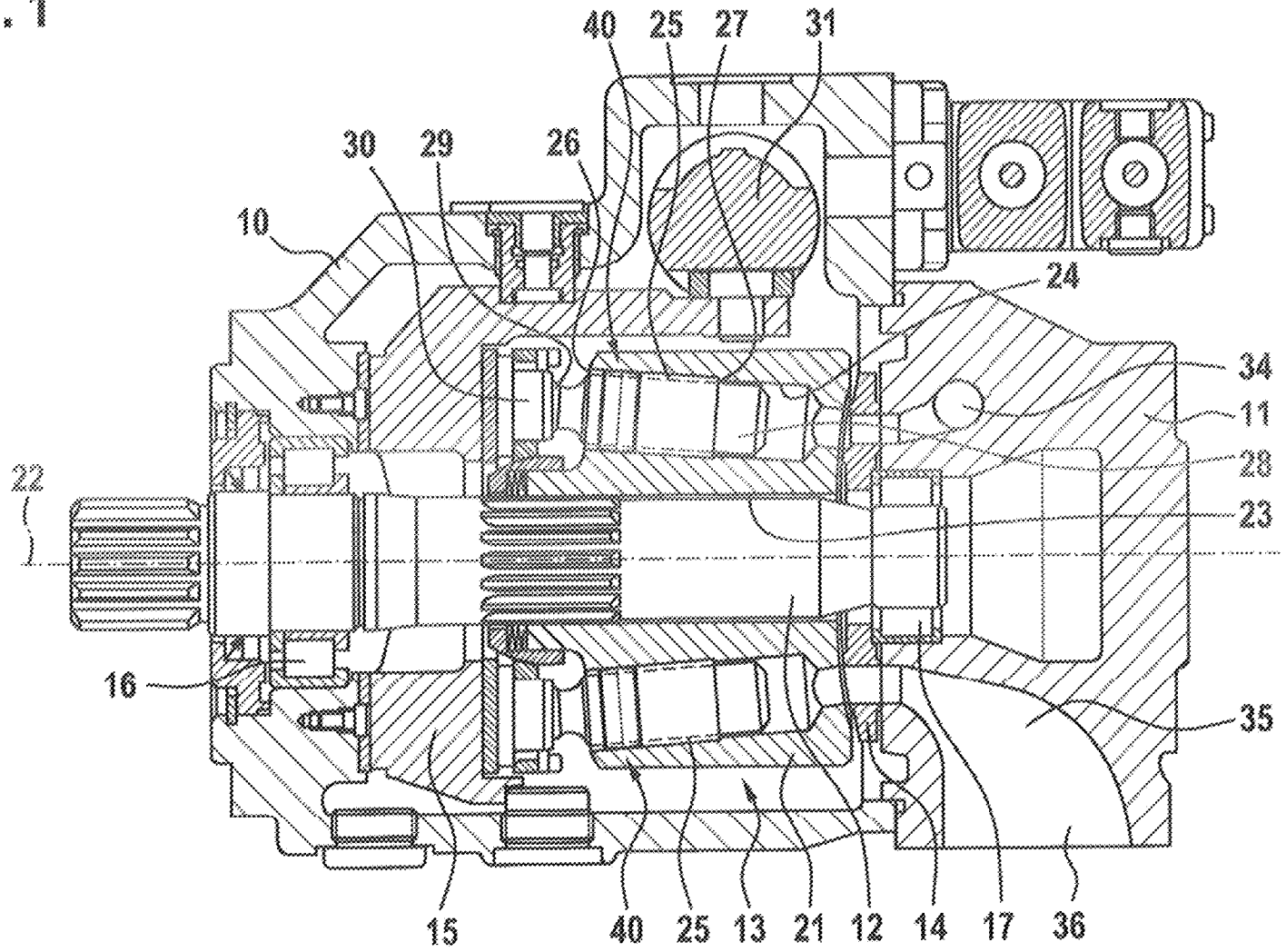
FIG. 1 a longitudinal section through a hydrostatic axial piston machine of adjustable displacement volume according to the first exemplary embodiment, FIG. 2 an extract from FIG. 1 in enlarged scale, wherein however a liner is shown in a front view, FIG. 3 in a further enlarged scale, an axial section through part of the liner fitted in the hydrostatic axial piston machine from FIGS. 1 and 2, with a first embodiment of a circumferential recess region, and FIG. 4 a section similar to that of FIG. 3 through a second liner which has a different configuration of a circumferential recess region.
Figure 2:
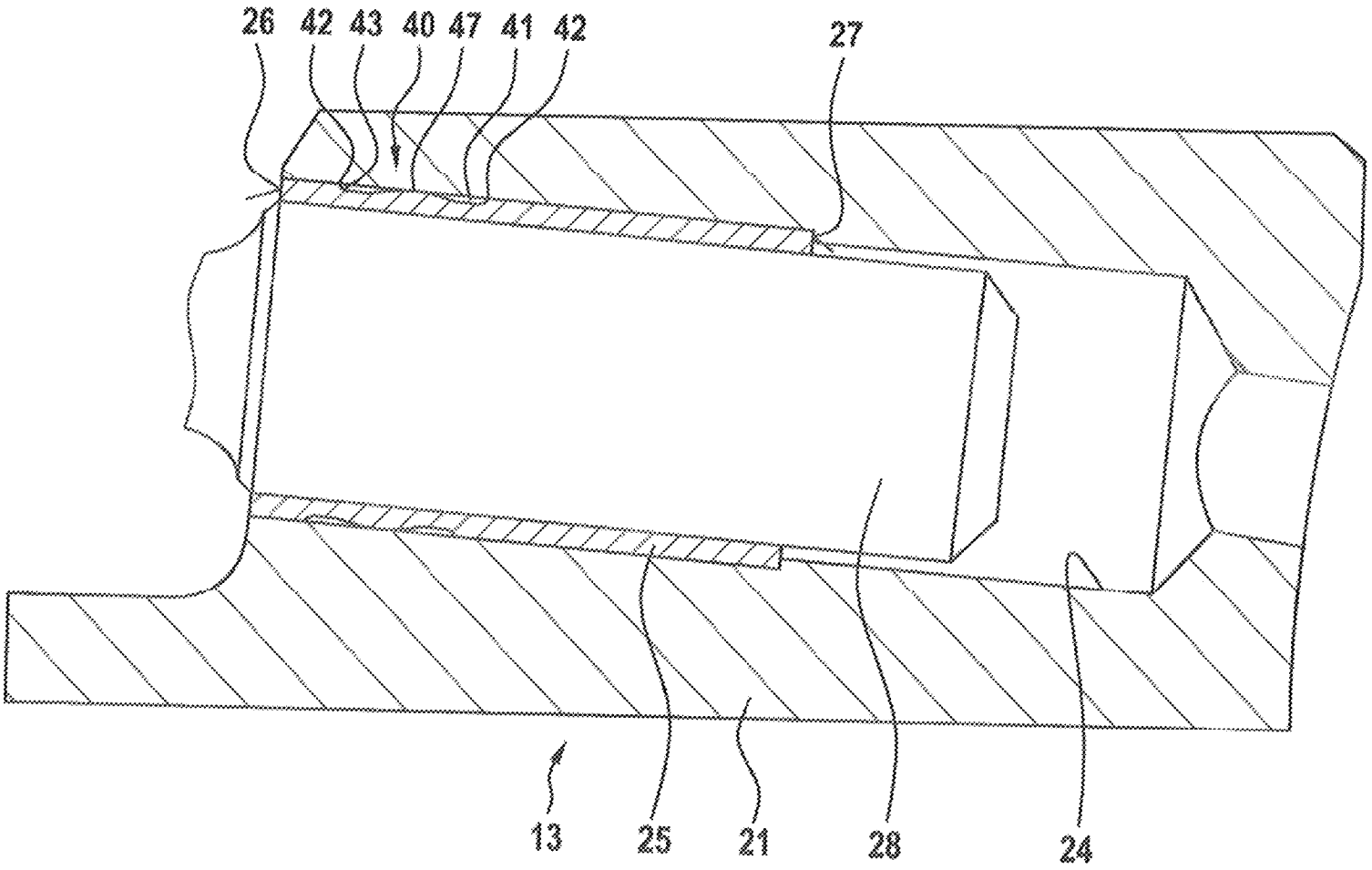

The hydrostatic axial piston machine in FIGS. 1 and 2 is a variable displacement pump in swashplate design for hydrostatic drives in an open hydraulic circuit. The volume flow of the variable displacement pump is proportional to the drive rotation speed and to the displacement volume, i.e. to the quantity of pressure medium conveyed per revolution. The variable displacement pump comprises a pot-like housing 10, a connecting plate 11 closing the open end of the housing 10, a drive shaft 12, a cylinder drum 13, a control plate 14 situated between the cylinder drum 13 and the connecting plate 11 and fixed relative to the connecting plate, and a swashplate 15 which is adjustable in its tilt relative to the axis of the drive shaft and is also called a pivot cradle because of its pivotability. The pivot cradle 15 may be pivoted from a position in which it stands almost perpendicular to the axis of the drive shaft 12, in a direction towards a maximum pivot angle.

The pivot angle may be not reduced fully to zero in order to always have a certain quantity of pressure fluid for cooling, for supplying the adjustment, for compensating for leakage fluid and for lubrication of all moving parts.

The drive shaft 12 is mounted rotatably in the base of the housing 10 and in the connecting plate 11 via roller bearings 16 and 17, and extends centrally through the cylinder drum 13. The latter is connected rotationally fixedly but axially movably to the drive shaft 12 and therefore may lie on the control plate 13 without play.

The cylinder drum 13 has a substantially circular cylindrical base body 21 with a central axis 22. The base body 21 has a central cavity 23 extending in the direction of the central axis, through which the drive shaft 12 passes. The base body 21 contains, evenly divided over the circumference, a plurality of for example nine cylinder bores 24 lying on the same pitch circle and, in this exemplary embodiment, set slightly obliquely relative to the central axis 22 which coincides with the central axis of the drive shaft 12. The diameter of the cylinder bores 24, in a front portion starting in an outer end face towards the swashplate and extending over around 60% of the total length of the cylinder bore, is slightly larger than in a rear portion. The two portions of a cylinder bore 24 transform into each other at a radial step.

In the portion of each cylinder bore 24 of larger diameter, a liner 25 is inserted which with its one outer end face 26 lies approximately flush with the opening of the cylinder bore 24. The fitting outer diameter D of the lining 25 and the inner diameter of the cylinder bore 24 are adapted to each other such that a press fit exists between the liner and the cylinder drum. A displacement piston 28 is guided axially movably in each liner 25. The inner diameter of a liner 25 is slightly smaller than the diameter of the rear portion of the cylinder bore 24, so that in this rear portion a clear ring gap exists between a displacement piston 28 and the wall of the cylinder bore 24.

At the end facing the pivot cradle 15, the displacement pistons 28 each have a ball-shaped head 29 which dips into a corresponding recess of a sliding shoe 30, so that a ball joint is formed between the displacement piston and the sliding shoe. By means of the sliding shoe 30, the displacement pistons rest on the pivot cradle 15 so that the displacement pistons 28 execute a reciprocating motion in the liners and in the cylinder bores during operation. The size of the stroke is determined by the tilt of the pivotable pivot cradle 15. To adjust the tilt of the pivot cradle 15, an adjustment device 31 is provided.

On their side facing away from the cylinder drum 13, the control openings of the control plate 14 are open to a first fluid channel 34 and to a second fluid channel 35 which are formed in the connecting plate 11, wherein fluid channel 34 leads to a pressure port (not shown in FIG. 1) and fluid channel 35 leads to a suction port 36 on the connecting plate 11. The cylinder bores 24 are open via passages to the end face of the cylinder drum 13 facing the control plate 14. On rotation of the cylinder drum 13, the passages sweep over the control openings of the control plate 14 and during a revolution are successively connected to the fluid channel 34 and the fluid channel 35 of the connecting plate 11.

In their outer half, in their outer casing surface 39, the liners 25 have a circumferential recess region 40 which is configured such that the risk of piston seizure at a high rotation speed and low operating pressure, and the risk of breakage of the liner at a high operating pressure, are reduced in comparison with known hydrostatic axial piston machines with compensated liners.

Figure 3:
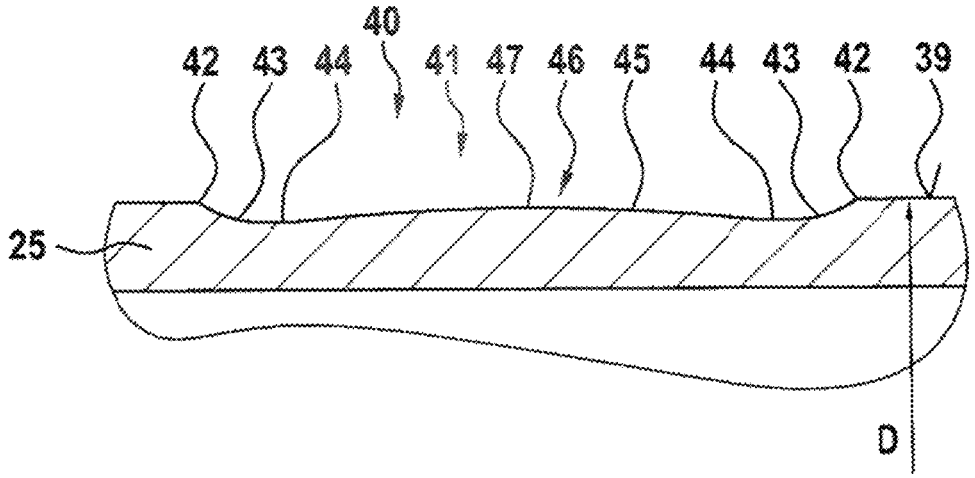

In the liners 25 from FIGS. 1 to 3, the circumferential recess region 40 consists of a single circumferential recess or groove 41 within which the outer diameter of a liner 25 is overall smaller than the fitting outer diameter with which the liner 25 is pressed into a cylinder bore 24. The width of the recess 41 in the axial direction of the liner 25 is around 25 to 30% of the total length of the liner. In an axial section through the liner 25 as shown in FIG. 3, and in which by definition the axis 32 of the liner lies, the contour starting from each peripheral side edge 42 of the recess 41 first falls in an inwardly curved first arc 43, which is convex viewed from the fitting outer diameter D of the liner and has a small radius of for example 2 mm, within a short axial extent amounting to around 10% of the width of the recess 41, to a lowest point 44 which lies for example 0.5 mm below the fitting outer diameter of the liner. The first circle arc extends upwardly for a short distance beyond the lowest point in order then to transform with constant tangent, i.e. without an edge, into an outwardly curved second circle arc 45, the radius of which is for example 50 mm. In this way, in the recess 41, a protrusion 46 is created which extends over around 80% of the width of the recess 41 and the highest point 47 of which is situated in the middle of the recess 41 and lies for example 0.2 mm below the fitting outer diameter of the liner. Viewed three-dimensionally, the protrusion 46, like the recess 41 with the cross-section evident from FIG. 3, runs on the outside around the liner 25.

In a hydrostatic axial piston machine which is equipped with liners 25 as shown in FIGS. 1 to 3, because of the recess 41, on severe heating of the particularly heavily loaded portion, a clearance is present into which the material of the liner may expand. Secondly, because of the protrusion 46, the strength of the liner 25 in the region of the recess 41 is improved in comparison with the known solution, so that the liner there deforms less. Also, on very severe load from high forces and an associated deformation, the liner is supported by the wall of the cylinder bore at the highest point of the protrusion 46. As a whole therefore, the risk of breakage of the liner is very low.

Figure 4:
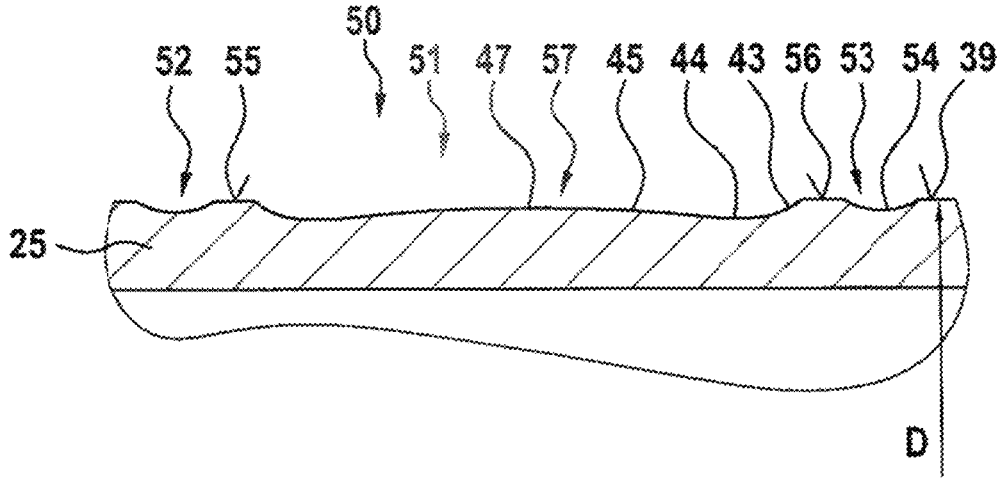

In the liner 25 of which an extract is shown in axial section in FIG. 4, the recess region 50 consists of three circumferential recesses 51, 52 and 53. These circumferential recesses are separated from each other by the circumferential ring faces 55 and 56 on the fitting outer diameter D of the liner. The middle recess 51 is narrower than the recess 41 in FIG. 3. Its width is around only 83% of the width of the recess 41. In its axial contour, the recess 51 however resembles the recess 41 from FIG. 3. Starting from each circumferential side edge of the recess 51, the contour first falls in a first circle arc, which is convex or inwardly curved viewed from the fitting outer diameter D and has a small radius of for example 2 mm, within a short axial extent to a lowest point which lies for example 0.5 mm below the fitting outer diameter D of the liner. The first circle arc extends upwardly for a short distance beyond the lowest point in order then to transform with constant tangent, i.e. without an edge, into a second outwardly curved circle arc with a radius of for example 30 mm. In this way, a protrusion 57 is created in the recess 51 which extends however only over around 75% of the width of the recess 51. The highest point of the protrusion 57 is again in the middle of the recess 51 and for example lies 0.2 mm below the fitting outer diameter of the liner.

The two side recesses 52 and 53 of identical form have a contour in the axial direction which is formed by a single circle arc 54 with a radius of 2 mm. This radius is selected such that at a maximal depth of 0.3 mm of a recess 52 and 53, a desired width of each recess 52 and 53 results of around 11% of the total width of the recess region 50 from FIG. 4. Each of the ring faces 55 and 56 extends over around 5%, and the middle recess 51 extends over around 68% of the total width of the recess region 50. The middle recess 51 could therefore be regarded as the main recess, and the two side recesses 52 and 53 as secondary recesses. The convex first circle arc of the main recess 51 and the circle arcs 54 of the secondary recesses 52 and 53 have the same radius, so that the main recess 51 and the secondary recesses 52 and 53 fall from a ring face 55 or 56 lying on the fitting outer diameter D of the liner 25, following the circle arcs 54 with the same radii, first steeply and then flatly to the respective maximal depth.

It has been found that, because of the additional support from the ring faces 55 and 56 inside the recess region 50, while retaining the same quality with regard to the avoidance of piston seizure, a liner is even more able to resist breakage than a liner with the recess region 40 from FIG. 3. However, the production of the recess region 50 is more complex in comparison with the production of the recess region 40.

LIST OF REFERENCE SIGNS

10 Pot-like housing
11 Connecting plate
12 Drive shaft
13 Cylinder drum
14 Control plate
15 Pivot cradle
16 Roller bearing
17 Roller bearing
21 Base body of 13
22 Centre axis of 12 and 21
23 Central cavity in 21
24 Cylinder bore
25 Liner
26 Outer end face of 25
27 Inner end face of 25
28 Displacement piston
29 Ball-shaped head of 28
30 Sliding shoe
31 Adjustment device
32 Axis of 25
34 First fluid channel
35 Second fluid channel
36 Suction port
39 Outer casing surface
40 Recess region 40 in 25
41 Recess
42 Side edge 41
43 First circle arc
44 Lowest point of 43
45 Second circle arc
46 Protrusion
47 Highest point
50 Recess region
51 Circumferential recess
52 Circumferential recess
53 Circumferential recess
54 Circle arc in 51, 52, 53
55 Circumferential ring face
56 Circumferential ring face
57 Protrusion
D Fitting outer diameter of 25

What is claimed is:

1. A hydrostatic axial piston machine, comprising:

a cylinder drum, including:

a substantially hollow cylindrical base body having a plurality of cylinder bores arranged around a central axis; and a plurality of liners, each liner configured to guide a respective displacement piston, each liner having:

a fitting outer diameter pressed into a respective cylinder bore;

an outer end face positioned in a region of an opening of the respective cylinder bore;

an inner end face positioned inside the respective cylinder bore;

an outer casing surface; and an axially delimited circumferential recess region in the outer casing surface, the recess region located in an outer half of the liner starting from the outer end face, and the recess region shaped such that in an axial section through the liner enclosing an axis of the liner, a depth of the recess region increases more than once and decreases more than once.

2. The hydrostatic axial piston machine of claim 1, wherein the recess region includes a recess having a protrusion that ends below the fitting outer diameter of the liner.

3. The hydrostatic axial piston machine of claim 2, wherein a highest point of the protrusion is pointed or linear.

4. The hydrostatic axial piston machine of claim 2, wherein the recess has a base that is curved, at least in regions, with a curvature that is greater than zero and less than infinity.

5. The hydrostatic axial piston machine of claim 4, wherein the protrusion extends over a portion of a width of the recess, the portion being between 70% and 85% of the width of the recess.

6. The hydrostatic axial piston machine of claim 4, wherein:

the base of the recess, starting from an edge lying on the fitting outer diameter of the liner, falls away to a lowest point following a first circle arc that is concave toward the fitting outer diameter and that has a first radius;

from the lowest point, the base continues following a second circle arc that is convex toward the fitting outer diameter, that has a second radius, and that adjoins the first circle arc with a constant tangent; and the first radius of the first circle arc is approximately 2 mm, and the second radius of the second circle arc is between 20 mm and 60 mm.

7. The hydrostatic axial piston machine of claim 2, wherein the protrusion is centered within the recess.

8. The hydrostatic axial piston machine of claim 2, wherein the recess runs in a ring-like manner around the liner, and has a same contour in each axial section enclosing the axis of the liner.

9. The hydrostatic axial piston machine of claim 1, wherein the recess region includes a plurality of individual recesses that are separated from each other by faces or edges lying on the fitting outer diameter of the liner.

10. The hydrostatic axial piston machine of claim 9, wherein the plurality of individual recesses are arranged successively in a direction of the axis of the liner.

11. The hydrostatic axial piston machine of claim 10, wherein the plurality of individual recesses run in a ring-like manner around the liner, each of the plurality of individual recesses having a same contour in each axial section enclosing the axis of the liner.

12. The hydrostatic axial piston machine of claim 9, wherein:

a first recess of the plurality of individual recesses is a main recess and has a first dimension in a direction of the axis of the liner;

at least one further recess in the plurality of individual recesses is at least one secondary recess that directly follows the main recess in the direction of the axis of the liner, and that has a second dimension in the direction along the axis of the liner that is smaller than the first dimension.

13. The hydrostatic axial piston machine of claim 12, wherein:

the main recess includes a protrusion that ends below the fitting outer diameter of the liner; and the at least one secondary recess, in an axial section enclosing the axis of the liner, has a circle-arced contour in which a depth of the secondary recess increases only once and decreases only once.

14. The hydrostatic axial piston machine of claim 12, wherein a respective secondary recess is located on each side of the main recess.

15. The hydrostatic axial piston machine of claim 14, wherein the respective secondary recesses on each side of the main recess have a same shape.

16. The hydrostatic axial piston machine of claim 10, wherein two of the plurality of individual recesses have different maximal depths.

17. The hydrostatic axial piston machine of claim 1, wherein:

the recess region includes:

a central main recess running in a ring-like manner around the liner, the central main recess having ring faces lying on the fitting outer diameter of the liner; and a respective secondary recess positioned on each side of the central main recess, each secondary recess running in a ring-like manner around the liner, the respective secondary recesses separated by the ring faces of the central main recess the main recess is wider than the respective secondary recesses;

the main central recess includes a protrusion that ends below the fitting outer diameter of the liner, and that is positioned in a middle of the main central recess; and the respective secondary recesses are shaped such that a depth of the respective secondary recesses only increases once and only decreases once.

18. The hydrostatic axial piston machine of claim 17, wherein:

at a location between the protrusion and one of the ring faces, the central main recess has a maximal depth that is greater than a maximal depth of the respective secondary recesses; and a minimal depth of the central main recess, at a highest point of the protrusion, is smaller than the maximal depth of the respective secondary recesses.

19. The hydrostatic axial piston machine of claim 17, wherein:

at a location between the protrusion and one of the ring faces, the central main recess has a maximal depth that is greater than a maximal depth of the respective secondary recesses; and the central main recess and the respective secondary recesses each fall away from the ring face following a contour defined by a common mathematical formula, at first steeply, and then flatly to a corresponding maximal depth.

20. The hydrostatic axial machine of claim 4, wherein an entirety of the base of the recess including the protrusion is formed without edges and without straight sections.

* * * * *